US011353205B1

(12) United States Patent
Li

(10) Patent No.: US 11,353,205 B1
(45) Date of Patent: Jun. 7, 2022

(54) ANTI-SHOCK NIGHT LIGHT

(71) Applicant: Xiamen Longstar Lighting Co., Ltd., Fujian (CN)

(72) Inventor: Xilong Li, Fujian (CN)

(73) Assignee: Xiamen Longstar Lighting Co., Ltd., Xiamen (CN)

( * ) Notice: Subject to any disclaimer, the term of this patent is extended or adjusted under 35 U.S.C. 154(b) by 0 days.

(21) Appl. No.: 17/371,440

(22) Filed: Jul. 9, 2021

(30) Foreign Application Priority Data

Nov. 13, 2020 (CN) ..... 202011271539.2

(51) Int. Cl.

| | |
|---|---|
| ***F21V 25/02*** | (2006.01) |
| ***F21V 23/00*** | (2015.01) |
| ***H01R 13/453*** | (2006.01) |
| ***F21V 23/06*** | (2006.01) |
| ***F21S 8/00*** | (2006.01) |

(52) U.S. Cl.
CPC ..... *F21V 25/02* (2013.01); *F21S 8/035* (2013.01); *F21V 23/003* (2013.01); *F21V 23/06* (2013.01); *H01R 13/4538* (2013.01)

(58) Field of Classification Search
CPC ..... F21S 10/046; F21S 9/02; F21V 14/08; F21V 17/10; F21V 23/06
See application file for complete search history.

(56) References Cited

U.S. PATENT DOCUMENTS 8,545,090 B2 * 10/2013 Chien ..... G04B 19/30 362/641
2019/0195445 A1 * 6/2019 Chien ..... F21S 8/035

FOREIGN PATENT DOCUMENTS

WO WO-9615567 A1 * 5/1996 ..... H01R 13/4538

* cited by examiner

*Primary Examiner* — Anabel Ton
(74) *Attorney, Agent, or Firm* — Cooper Legal Group, LLC

(57) ABSTRACT

An anti-shock night light comprises pins, a night light main body, an anti-shock device, and an elastic resetting member. A first end of the anti-shock device is movably connected to an opening to enable the anti-shock device to move in a length direction of the pins, and a second end of the anti-shock device extends away from the night light main body along the length direction so as to enable a part of the pins, which is exposed out of the night light main body, to be contained within the anti-shock device. When plugging the pins into a socket, the anti-shock device abuts the socket and is retracted toward the night light main body to enable the part of the pins to be exposed and plugged into the socket. When the anti-shock device is retracted toward the night light main body, the elastic resetting member generates an elastic resetting force.

19 Claims, 8 Drawing Sheets

ANTI-SHOCK NIGHT LIGHT

RELATED APPLICATIONS

This application claims priority to Chinese patent application number 202011271539.2, filed on Nov. 13, 2020. Chinese patent application number 202011271539.2 is incorporated herein by reference.

FIELD OF THE DISCLOSURE

The present disclosure relates to a light emitting device, and in particular to a night light.

BACKGROUND OF THE DISCLOSURE

The night light is an indoor lighting fixture used at night that has gradually entered every family's home. The night light provides subdued illumination at night without affecting people's rest. There are many types of night lights on the market, which can be roughly divided into two categories. The first category of night lights comprises a photosensitive device, which is turned on at night and turned off in the day, and the second category of night lights comprises a voice control or infrared sensor module, which only lights up at night when people are active. The first category and the second category of night lights have a common trait: most of them are directly plugged into a socket to be provided power. When plugging or unplugging the night lights, an electric shock may be caused by accidentally touching the metal of a plug with fingers, especially in families with children.

BRIEF SUMMARY OF THE DISCLOSURE

The present disclosure provides an anti-shock night light with a function of anti-shock.

In order to solve the technical problem, a technical solution of the present disclosure is as follows.

An anti-shock night light, comprises pins, a night light main body, an anti-shock device, and an elastic resetting member. A first end of the night light main body comprises an opening which the pins extends out of. A first end of the anti-shock device is movably connected to the opening to enable the anti-shock device to move in a length direction of the pins, and a second end of the anti-shock device extends away from the night light main body along the length direction of the pins so as to enable a part of the pins, which is exposed out of the night light main body, to be contained within the anti-shock device. When plugging the pins into a socket, the anti-shock device abuts the socket and is retracted toward the night light main body so as to enable the part of the pins to be exposed and to be plugged into the socket. When the anti-shock device is retracted toward the night light main body, the elastic resetting member generates an elastic resetting force.

In a preferred embodiment, the anti-shock device comprises an insulating housing. A side of the insulating housing facing the night light main body defines an opening surface, and a part of the insulating housing disposed on an outer circumference of the opening surface extends into the opening. The part of the insulating housing disposed on the outer circumference of the opening surface comprises a hook, and the hook is configured to limit outward movement of the insulating housing away from the night light main body in the length direction of the pins.

In a preferred embodiment, a side of the insulating housing facing away from the night light main body comprises space-providing holes corresponding to the pins in a one-to-one correspondence.

In a preferred embodiment, the elastic resetting member is at least one spring, and the elastic resetting member is disposed in the insulating housing. A first end of the elastic resetting member abuts an inner wall of the insulating housing, and a second end of the elastic resetting member fixedly abuts the night light main body through the opening surface.

In a preferred embodiment, the at least one spring is one spring or two springs.

In a preferred embodiment, the night light main body comprises a light guiding column, a driver board, an upper cover, a lens, a photosensitive tube, and a lower cover. The upper cover and the lower cover are buckled to each other to define a chamber configured to receive the lens and the photosensitive tube, and the lower cover comprises the opening.

In a preferred embodiment, the lens is embedded and installed on a top portion of the upper cover.

In a preferred embodiment, the light guiding column is disposed outside of the lower cover, and one end of the light guiding column is embedded and installed on a side wall of the lower cover.

In a preferred embodiment, the photosensitive tube is welded to the driver board.

Compared with the existing techniques, the technical solution has the following advantages.

The present disclosure provides an anti-shock night light. The anti-shock night light comprises the anti-shock device which is disposed on a plug comprising the pins. When the anti-shock night light is plugged into the socket, the anti-shock device will be slowly pressed into the night light main body. When unplugging the anti-shock night light from the socket, the anti-shock device will slowly reset due to the elastic resetting member to block a part of the pins, which has been pulled out, so as to prevent people's fingers from accidentally touching the plug and prevent electric shock accidents. Therefore, the anti-shock night light is very safe.

DETAILED DESCRIPTION OF THE EMBODIMENTS

Figure 1:
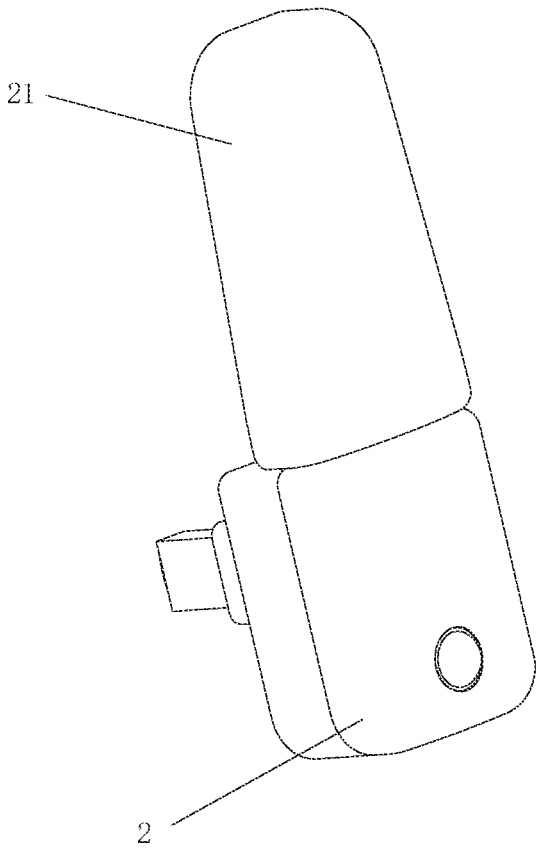
FIG. 1 illustrates a perspective view of an anti-shock night light in embodiment 1 of the present disclosure.
Figure 2:
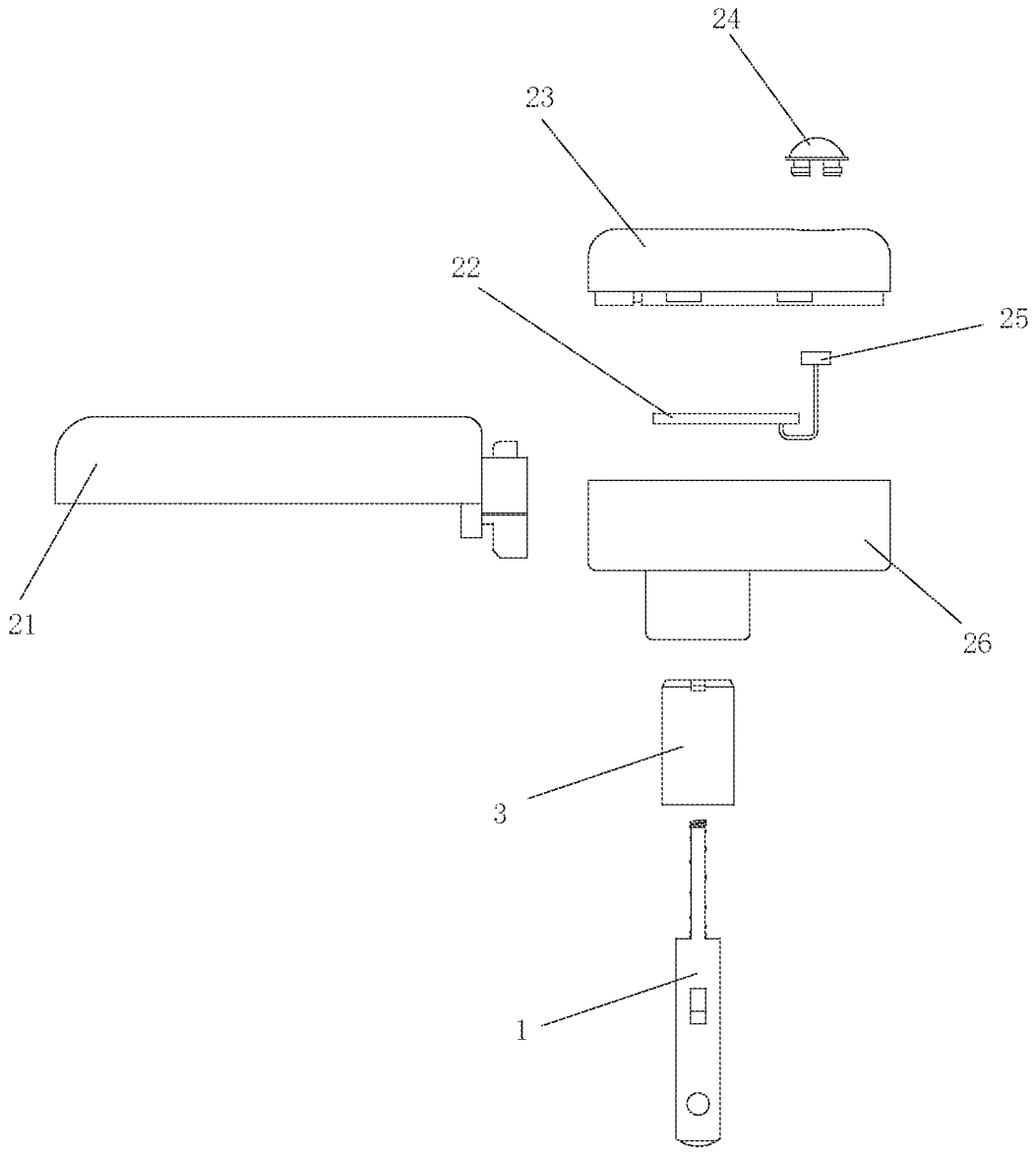
FIG. 2 illustrates an exploded view of the anti-shock night light in the embodiment 1 of the present disclosure.
Figure 3:
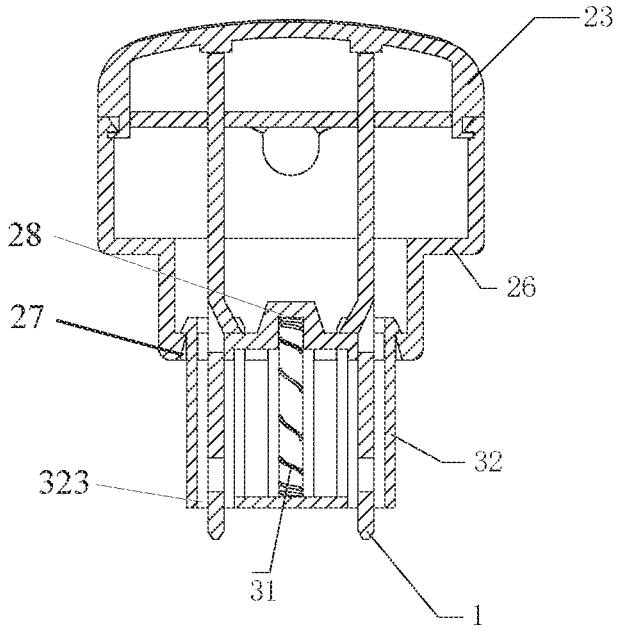
FIG. 3 illustrates a cross-sectional view of the anti-shock night light in the embodiment 1 of the present disclosure when the anti-shock night light is not plugged into a socket.
Figure 4:
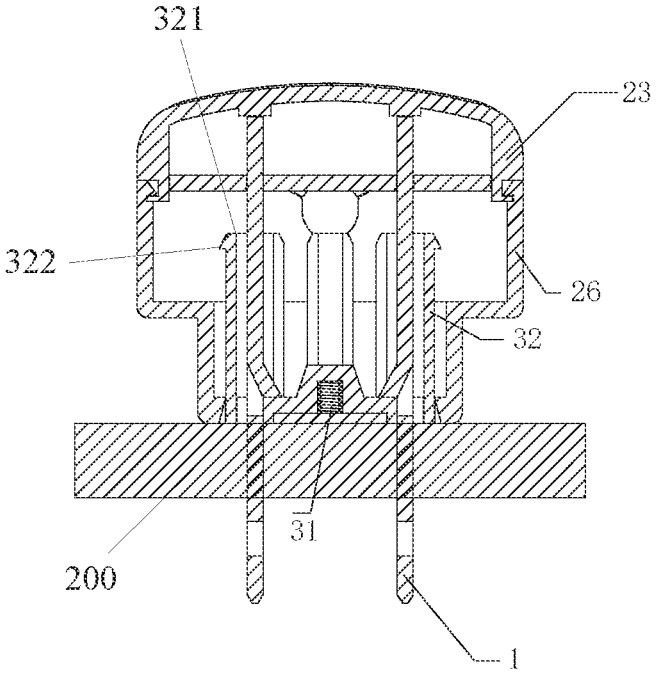
FIG. 4 illustrates a cross-sectional view of the anti-shock night light in the embodiment 1 of the present disclosure when the anti-shock night light is plugged into the socket.
Figure 5:
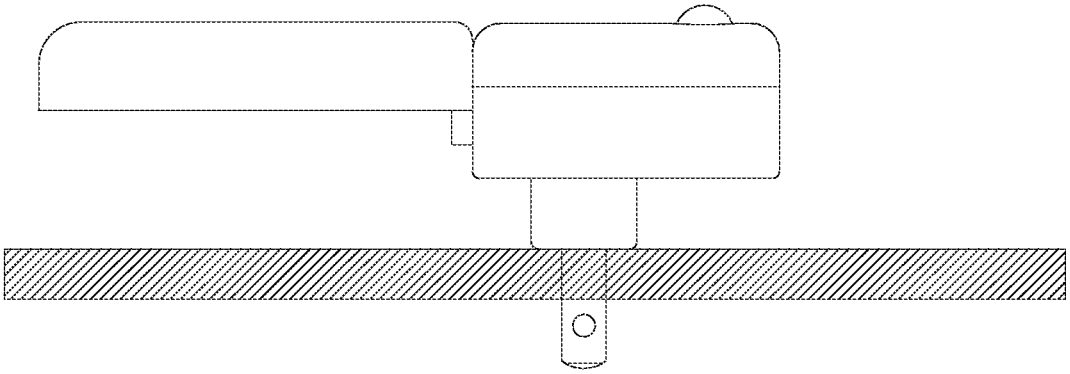
FIG. 5 illustrates a side view of the anti-shock night light in the embodiment of the present disclosure when the anti-shock night light is not plugged into the socket.
Figure 6:
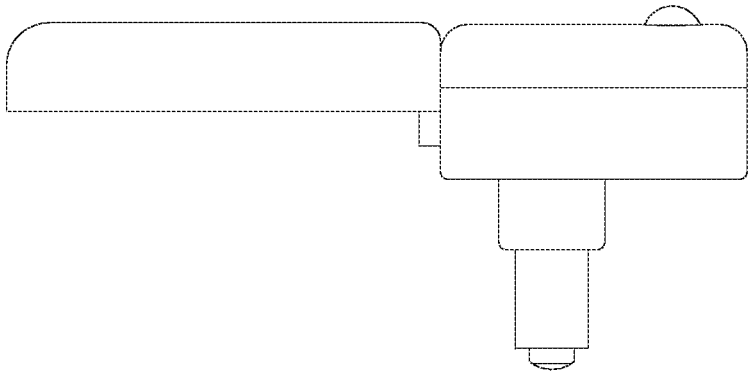
FIG. 6 illustrates a side view of the anti-shock night light in the embodiment of the present disclosure when the anti-shock night light is plugged into the socket.

The present disclosure will be further described below in combination with the accompanying drawings and embodiments.

The following will clearly and completely describe the technical solutions in the embodiments of the present disclosure with reference to the accompanying drawings. Obviously, the described embodiments are only a portion of the embodiments of the present disclosure, and not all of the embodiments. Based on the embodiments of the present disclosure, all other embodiments obtained by those of ordinary skill in the art without creative work fall within the protection scope of the present disclosure.

In the description of the present disclosure, it should be noted that the terms "upper", "lower", "inner", "outer", "top/bottom", etc. indicate the orientation or positional relationship based on the orientation shown in the drawings. The positional relationship is only for the convenience of describing the present disclosure and simplifying the description, rather than indicating or implying that the pointed device or element must have a specific orientation, be constructed, and be operated in a specific orientation. Therefore, the positional relationship should not be understood as a limitation of the present disclosure. In addition, the terms "first" and "second" are only used for descriptive purposes and should not be understood as indicating or implying relative importance.

In the description of the present disclosure, it should be noted that the terms "installed", "provided with", "sleeved/connected", "connected", etc., should be understood broadly. For example, "connected" can be a fixed connection, a detachable connection, or an integral connection, a mechanical connection, an electrical connection, a direct connection, or an indirect connection through an intermediate medium, and it can be a connection between two members. For those of ordinary skill in the art, the specific meaning of the above terms in the present disclosure can be understood under specific conditions.

Embodiment 1

Referring to FIGS. 1-6, an anti-shock night light of this embodiment is provided and comprises pins 1, a night light main body 2, and an anti-shock device 3.

A first end of the night light main body 2 comprises an opening 27 which the pins 1 extends out of. A first end of the anti-shock device 3 is movably connected to the opening 27 to enable the anti-shock device 3 to move in a length direction of the pins 1, and a second end of the anti-shock device 3 extends away from the night light main body 2 along the length direction of the pins 1 so as to enable a part of the pins 1, which is exposed out of the night light main body 2, to be contained within the anti-shock device 3.

When plugging the pins 1 into a socket 200, the anti-shock device 3 abuts the socket 200 and is retracted toward the night light main body 2 so as to enable the part of the pins 1 to be exposed and to be plugged into the socket 200. When the anti-shock device 3 is retracted toward the night light main body 2, an elastic resetting member 31 generates an elastic resetting force.

The anti-shock night light comprises the anti-shock device 3, which is disposed on a plug comprising the pins 1. When the anti-shock night light is plugged into the socket 200, the anti-shock device 3 will be slowly pressed into the night light main body 2. When unplugging the anti-shock night light from the socket 200, the anti-shock device 3 will slowly reset due to the elastic resetting member 31 (e.g., a spring) to block a part of the pins 1, which has been pulled out of the socket 200, so as to prevent people's fingers from accidentally touching the plug and prevent electric shock accidents. Therefore, the anti-shock night light is very safe.

Specifically, the anti-shock device 3 comprises an insulating housing 32, and a side of the insulating housing 32 facing the night light main body 2 defines an opening surface 321. A part of the insulating housing 32 disposed on an outer circumference of the opening surface 321 extends into the opening 27 and comprises a hook 322 configured to limit outward movement of the insulating housing 32 away from the night light main body 2 in the length direction of the pins 1.

In order to allow the pins 1 to enter and exit the insulating housing 32 freely, a side of the insulating housing 32 facing away from the night light main body 2 comprises space-providing holes 323 corresponding to the pins 1 in a one-to-one correspondence.

In this embodiment, the elastic resetting member 31 is a spring and is disposed in the insulating housing 32. A first end of the elastic resetting member 31 abuts an inner wall of the insulating housing 32, and a second end of the elastic resetting member 31 fixedly abuts the night light main body 2 through the opening surface 321. Furthermore, there exists a single spring in this embodiment disposed along a center axis of the insulating housing 32, and the night light main body 2 comprises a groove 28 disposed on an inner wall of the opening 27. The groove 28 is configured to fixedly receive the second end of the elastic resetting member 31.

The night light main body 2 comprises a light guiding column 21, a driver board 22, an upper cover 23, a lens 24, a photosensitive tube 25, and a lower cover 26. The upper cover 23 and the lower cover 26 are buckled to each other to define a chamber configured to receive the lens 24 and the photosensitive tube 25. The lower cover 26 comprises the opening 27. The lens 24 is embedded and installed on a top portion of the upper cover 23. The light guiding column 21 is disposed outside of the lower cover 26, and one end of the light guiding column 21 is embedded and installed on a side wall of the lower cover 26. The photosensitive tube 25 is welded to the driver board 22.

The design of the night light main body 2 is not the main point of the design of this embodiment, so it will not be further described.

Embodiment 2

Figure 7:
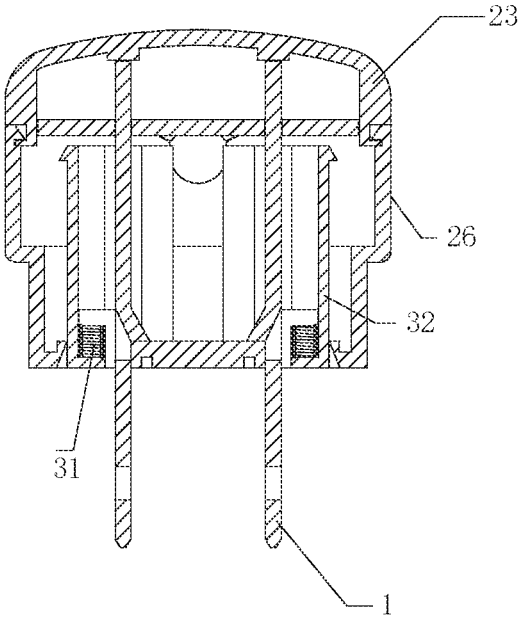
FIG. 7 illustrates a cross-sectional view of an anti-shock night light in embodiment 2 of the present disclosure when the anti-shock night light is not plugged into the socket.
Figure 8:
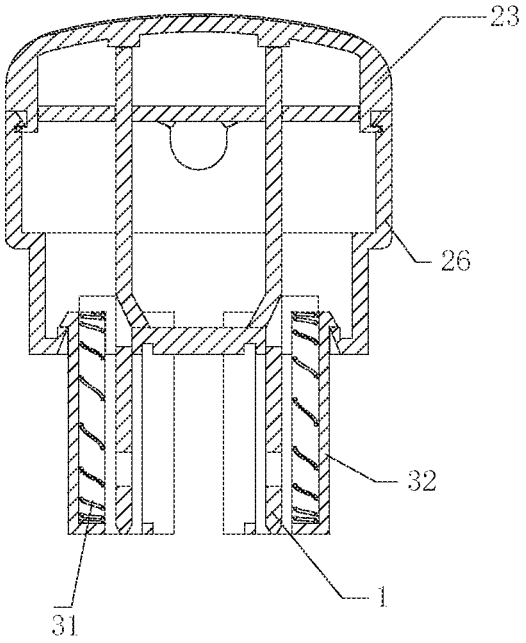
FIG. 8 illustrates a cross-sectional view of the anti-shock night light in the embodiment 2 of the present disclosure when the anti-shock night light is plugged into the socket.

Referring to FIGS. 7 and 8, the difference between this embodiment and the embodiment 1 is that the elastic resetting member 31 is two springs in this embodiment, which are arranged symmetrically along the central axis of the insulating housing 32. The rest is the same as the embodiment 1 and will not be repeated.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. An anti-shock night light, comprising:

pins, a night light main body, an anti-shock device, and an elastic resetting member, wherein:

a first end of the night light main body comprises an opening which the pins extend out of, a first end of the anti-shock device is movably connected to the opening to enable the anti-shock device to move in a length direction of the pins, a second end of the anti-shock device extends away from the night light main body along the length direction of the pins so as to enable a part of the pins, which is exposed out of the night light main body, to be contained within the anti-shock device, the anti-shock device comprises an insulating housing, a side of the insulating housing facing the night light main body defines an opening surface, a part of the insulating housing disposed on an outer circumference of the opening surface extends into the opening, the part of the insulating housing disposed on the outer circumference of the opening surface comprises a hook, the hook is configured to limit outward movement of the insulating housing away from the night light main body in the length direction of the pins, when plugging the pins into a socket, the anti-shock device abuts the socket and is retracted toward the night light main body so as to enable the part of the pins to be exposed and to be plugged into the socket, and when the anti-shock device is retracted toward the night light main body, the elastic resetting member generates an elastic resetting force.

2. The anti-shock night light according to claim 1, wherein:

a side of the insulating housing facing away from the night light main body comprises space-providing holes corresponding to the pins in a one-to-one correspondence.

3. The anti-shock night light according to claim 2, wherein:

the elastic resetting member is at least one spring, the elastic resetting member is disposed in the insulating housing, a first end of the elastic resetting member abuts an inner wall of the insulating housing, and a second end of the elastic resetting member fixedly abuts the night light main body through the opening surface.

4. The anti-shock night light according to claim 3, wherein:

the at least one spring is one spring or two springs.

5. The anti-shock night light according to claim 1, wherein:

the night light main body comprises a light guiding column, a driver board, an upper cover, a lens, a photosensitive tube, and a lower cover, the upper cover and the lower cover are buckled to each other to define a chamber configured to receive the lens and the photosensitive tube, and the lower cover comprises the opening.

6. The anti-shock night light according to claim 5, wherein:

the lens is embedded and installed on a top portion of the upper cover.

7. The anti-shock night light according to claim 5, wherein:

the light guiding column is disposed outside of the lower cover, and one end of the light guiding column is embedded and installed on a side wall of the lower cover.

8. The anti-shock night light according to claim 5, wherein:

the photosensitive tube is welded to the driver board.

9. The anti-shock night light according to claim 2, wherein:

the night light main body comprises a light guiding column, a driver board, an upper cover, a lens, a photosensitive tube, and a lower cover, the upper cover and the lower cover are buckled to each other to define a chamber configured to receive the lens and the photosensitive tube, and the lower cover comprises the opening.

10. The anti-shock night light according to claim 3, wherein:

the night light main body comprises a light guiding column, a driver board, an upper cover, a lens, a photosensitive tube, and a lower cover, the upper cover and the lower cover are buckled to each other to define a chamber configured to receive the lens and the photosensitive tube, and the lower cover comprises the opening.

11. The anti-shock night light according to claim 4, wherein:

the night light main body comprises a light guiding column, a driver board, an upper cover, a lens, a photosensitive tube, and a lower cover, the upper cover and the lower cover are buckled to each other to define a chamber configured to receive the lens and the photosensitive tube, and the lower cover comprises the opening.

12. The anti-shock night light according to claim 9, wherein:

the lens is embedded and installed on a top portion of the upper cover.

13. The anti-shock night light according to claim 9, wherein:

the light guiding column is disposed outside of the lower cover, and one end of the light guiding column is embedded and installed on a side wall of the lower cover.

14. The anti-shock night light according to claim 9, wherein:

the photosensitive tube is welded to the driver board.

15. The anti-shock night light according to claim 10, wherein:

the lens is embedded and installed on a top portion of the upper cover.

16. An anti-shock night light, comprising:

pins, a night light main body, an anti-shock device, and an elastic resetting member, wherein:

a first end of the night light main body comprises an opening which the pins extend out of, a first end of the anti-shock device is movably connected to the opening to enable the anti-shock device to move in a length direction of the pins, a second end of the anti-shock device extends away from the night light main body along the length direction of the pins so as to enable a part of the pins, which is exposed out of the night light main body, to be contained within the anti-shock device, the night light main body comprises a light guiding column, a driver board, an upper cover, a lens, a photosensitive tube, and a lower cover, the upper cover and the lower cover are buckled to each other to define a chamber configured to receive the lens and the photosensitive tube, the lower cover comprises the opening, when plugging the pins into a socket, the anti-shock device abuts the socket and is retracted toward the night light main body so as to enable the part of the pins to be exposed and to be plugged into the socket, and when the anti-shock device is retracted toward the night light main body, the elastic resetting member generates an elastic resetting force.

17. The anti-shock night light according to claim 16, wherein:

the lens is embedded and installed on a top portion of the upper cover.

18. The anti-shock night light according to claim 16, wherein:

the light guiding column is disposed outside of the lower cover, and one end of the light guiding column is embedded and installed on a side wall of the lower cover.

19. The anti-shock night light according to claim 16, wherein:

the photosensitive tube is welded to the driver board.

* * * * *